US011452338B2

(12) United States Patent
Kilgore et al.

(10) Patent No.: US 11,452,338 B2
(45) Date of Patent: Sep. 27, 2022

(54) ARTICLE OF FOOTWEAR

(71) Applicant: NIKE, Inc., Beaverton, OR (US)

(72) Inventors: Bruce J. Kilgore, Lake Oswego, OR (US); Matthew Kilgore, Portland, OR (US); Sara Kilgore, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 124 days.

(21) Appl. No.: 16/218,072

(22) Filed: Dec. 12, 2018

(65) Prior Publication Data

US 2019/0174868 A1 Jun. 13, 2019

Related U.S. Application Data

(60) Provisional application No. 62/598,250, filed on Dec. 13, 2017.

(51) Int. Cl.
*A43B 23/02* (2006.01)
*A43B 23/04* (2006.01)
(Continued)

(52) U.S. Cl.
CPC ..... *A43B 23/0245* (2013.01); *A43B 23/0205* (2013.01); *A43B 23/0255* (2013.01); *A43B 23/042* (2013.01); *A43B 23/07* (2013.01); *A43B 23/26* (2013.01); *A43B 1/04* (2013.01); *A43B 9/00* (2013.01); *A43B 11/00* (2013.01); *A43B 23/025* (2013.01); *A43B 23/027* (2013.01)

(58) Field of Classification Search
CPC ..... A43B 23/0245; A43B 23/025; A43B 23/0255; A43B 23/042
USPC ..... 36/47, 48, 49
See application file for complete search history.

(56) References Cited

U.S. PATENT DOCUMENTS 198,005 A * 12/1877 Dowling ..... A43B 23/02 36/47
1,011,539 A * 12/1911 Weis ..... A43B 23/025 112/418

(Continued)

FOREIGN PATENT DOCUMENTS

CN 101152027 A 4/2008
CN 102573546 A 7/2012

(Continued)

OTHER PUBLICATIONS

International Search Report and Written Opinion dated Apr. 1, 2019 in International Patent Application No. PCT/US2018/065499.

(Continued)

*Primary Examiner* — Sharon M Prange
(74) *Attorney, Agent, or Firm* — Shook, Hardy & Bacon L.L.P.

(57) ABSTRACT

An article of footwear formed from a flat pattern. The article of footwear has a reduced seam construction to reduce manufacturing operations. A toe-end seam extending from a throat on a medial side of the article of footwear provides a seaming option. An acute-angle indentation on a lateral side of the throat allows the article of footwear to conform to a wearer's traditional foot. A heel-end seam having adjacent inner surfaces of medial and lateral portions of the upper may also be included to convert the flat pattern upper to a dimensional article of footwear that conforms to the wearer's traditional foot.

19 Claims, 7 Drawing Sheets

(51) Int. Cl.

| | |
|---|---|
| ***A43B 23/26*** | (2006.01) |
| ***A43B 23/07*** | (2006.01) |
| *A43B 9/00* | (2006.01) |
| *A43B 1/04* | (2022.01) |
| *A43B 11/00* | (2006.01) |

(56) References Cited

U.S. PATENT DOCUMENTS

| | | | | |
|---|---|---|---|---|
| 1,880,389 | A * | 10/1932 | Heilhecker | A43B 5/00 36/9 R |
| 2,325,656 | A * | 7/1943 | Brophy | A43B 23/16 12/146 R |
| 2,376,398 | A | 5/1945 | Steffanson | |
| 2,384,927 | A | 9/1945 | Julianelli | |
| 2,494,617 | A * | 1/1950 | Hogan | A43B 3/106 36/11 |
| 2,974,427 | A * | 3/1961 | Wolff | A43B 3/14 36/11 |
| 3,291,085 | A * | 12/1966 | Levy | D05B 93/00 112/475.09 |
| 5,345,638 | A * | 9/1994 | Nishida | A41H 3/08 12/146 C |
| 7,913,424 | B1 * | 3/2011 | Raith | A43B 9/02 36/55 |
| 8,042,288 | B2 * | 10/2011 | Dua | A43D 8/00 36/45 |
| 8,196,317 | B2 * | 6/2012 | Dua | D04B 1/22 36/50.1 |
| 2008/0083138 | A1 | 4/2008 | Lacorazza et al. | |
| 2011/0289797 | A1 | 12/2011 | Madelaine et al. | |
| 2014/0157623 | A1 * | 6/2014 | Dekovic | A43B 23/0215 36/47 |
| 2014/0245633 | A1 | 9/2014 | Podhajny | |
| 2017/0303639 | A1 | 10/2017 | Ito et al. | |

FOREIGN PATENT DOCUMENTS

| | | | |
|---|---|---|---|
| CN | 103156331 | A | 6/2013 |
| CN | 203105801 | U | 8/2013 |
| CN | 105249619 | A | 1/2016 |
| CN | 105530827 | A | 4/2016 |
| CN | 205585436 | U | 9/2016 |
| CN | 106174879 | A | 12/2016 |
| CN | 107072354 | A | 8/2017 |
| DE | 4016217 | A1 | 11/1991 |

OTHER PUBLICATIONS

International Preliminary Report on Patentability received for PCT Patent Application No. PCT/US2018/065499, dated Jun. 25, 2020, 10 pages.

* cited by examiner

ARTICLE OF FOOTWEAR

CROSS-REFERENCE TO RELATED APPLICATIONS

This application claims the benefit of priority of U.S. Provisional Application No. 62/598,250, entitled "Articles of Footwear," and filed Dec. 13, 2017. The entirety of the aforementioned application is incorporated by reference herein.

FIELD

The field relates to an article of footwear.

BACKGROUND

Footwear, such as a shoe, is generally manufactured from a variety of discrete portions that are joined in multiple manufacturing steps to form a dimensional article. Manufacturing steps can increase the cost of the resulting footwear through increased labor and increased opportunities for errors.

SUMMARY

This summary is intended to provide a high-level overview of this disclosure and to introduce a selection of concepts that are further described below in the detailed description section hereof. This summary is not intended to identify key or essential features of the subject matter of this disclosure, nor is it intended to be used as an aid in isolation to determine the scope of the claimed subject matter.

At a high level, this aspects provided herein relate generally to an article of footwear having an efficient footwear upper pattern for assembly. A seam is formed extending from a throat opening of the upper towards a toe end of the article of footwear on a medial side. The pattern may also include a heel-end seam. The heel-end seam extends from the ankle opening towards a bottom edge of the pattern when assembled as the article of footwear. As part of an efficient pattern for the article of footwear upper, an acute angle indentation along a lateral edge of the throat opening may be present to facilitate a transition from a quarter panel orientation to a toebox orientation of the footwear upper.

BRIEF DESCRIPTION OF THE FIGURES

The subject matter of this disclosure is described in detail herein with reference to the attached figures, which depict exemplary and non-limiting aspects hereof, in which.

DETAILED DESCRIPTION

The subject matter of this disclosure is described with specificity herein to meet statutory requirements. However, the description is not intended to limit the scope of this disclosure. Rather, the claimed subject matter may be provided in other ways, to include different features, elements, arrangements, steps, and/or combinations of features, elements, arrangements, and/or steps, similar to the ones described in this disclosure, and in conjunction with other present and/or future technologies. The terms "step" and "block" should not be interpreted as implying any particular order among the elements of methods employed herein unless and except when the order of individual steps or blocks is explicitly described and required.

At a high level, this disclosure relates generally to an article of footwear having an efficient footwear upper pattern for assembly. A seam is formed extending from a throat opening of the upper towards a toe end of the article of footwear on a medial side. The pattern may also include a heel-end seam. The heel-end seam extends from the ankle opening towards a bottom edge of the pattern when assembled as the article of footwear. As part of an efficient pattern for the article of footwear upper, an acute angle indentation along a lateral edge of the throat opening may be present to facilitate a transition from a quarter panel orientation to a toebox orientation of the footwear upper.

In an exemplary aspect, an article of footwear having a medial side, a lateral side, a toe end, a heel end, and a medial toebox seam is provided. The article of footwear includes a footbed portion; a medial upper portion; and a lateral upper portion. The medial upper portion and the lateral upper portion, in this example, form a seam extending from the footbed portion to a throat opening along a medial portion of a toebox portion.

In another exemplary aspect, an article of footwear having a medial side, a lateral side, a toe end, a heel end, and a heel seam is provided. The article of footwear includes a footbed portion; a medial upper portion having an inner surface and an opposite outer surface; and a lateral upper portion having an inner surface and an opposite outer surface. The medial upper portion and the lateral upper portion form a seam extending from an ankle opening towards a biteline with the medial upper portion inner surface and the lateral upper portion inner surface are adjacent at the seam.

Another exemplary aspect contemplates an article of footwear having a medial side, a lateral side, a toe end, a heel end, and a heel seam. The article of footwear includes a medial upper portion and a lateral upper portion. The lateral upper portion includes a throat-opening edge that extends from an ankle opening to a toebox. The throat-opening edge forms an acute-angle indentation between the ankle opening and the toebox on the lateral side.

Figure 7:
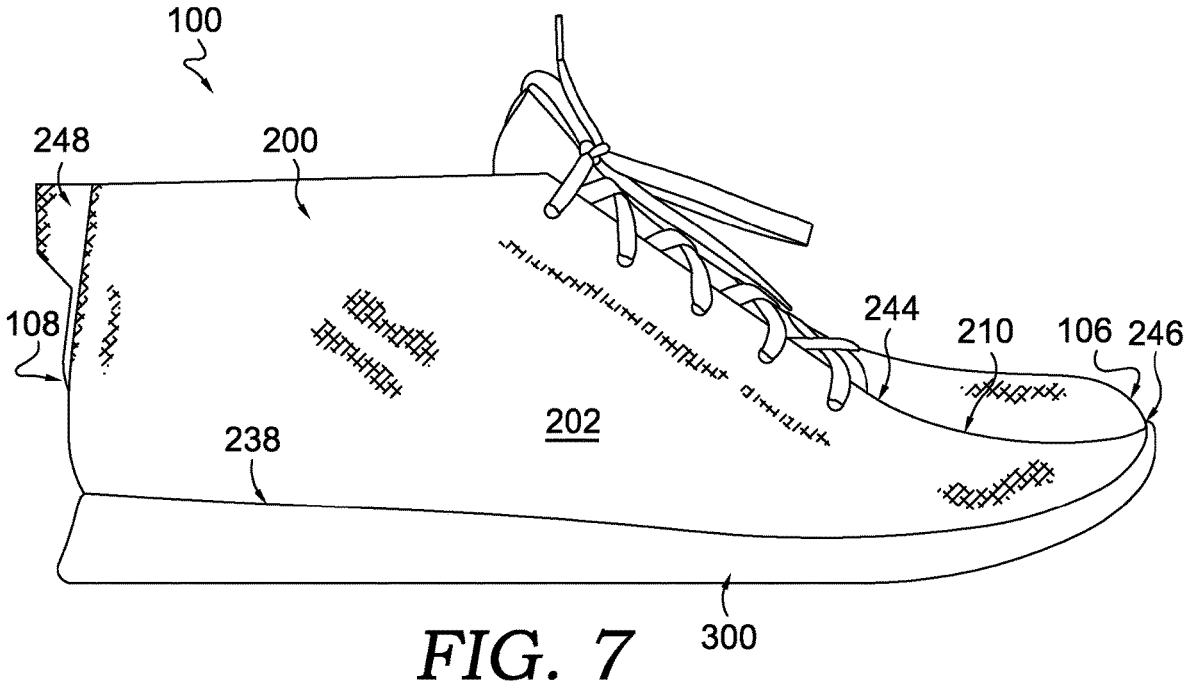
FIG. 7 depicts the article of footwear from FIG. 1 having a sole, in accordance with aspects hereof.
Figure 8:
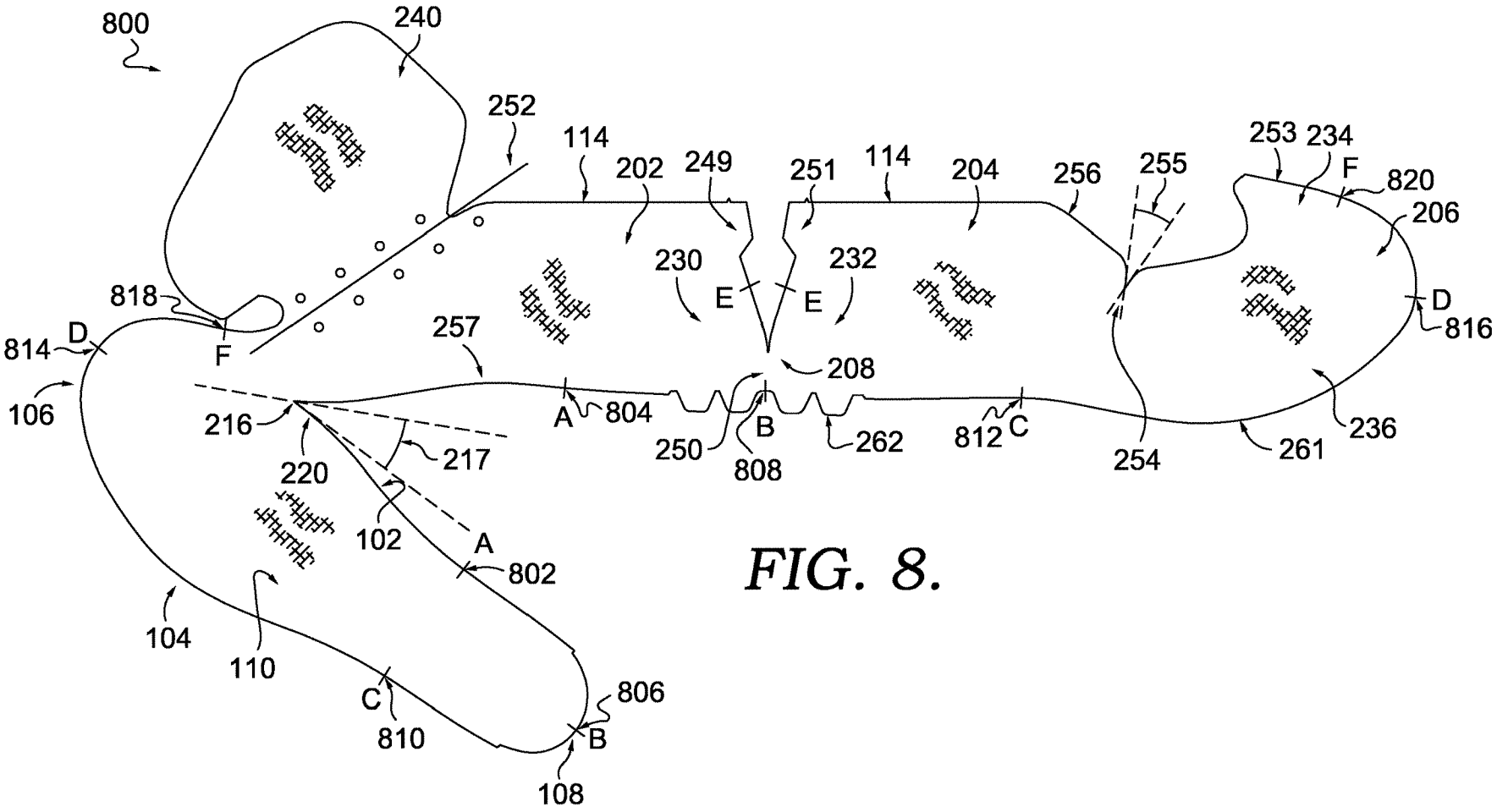
FIG. 8 depicts a flat pattern upper effective to convert into the dimensional article of footwear of FIGS. 1-6B, in accordance with an aspect hereof.
Figure 9:
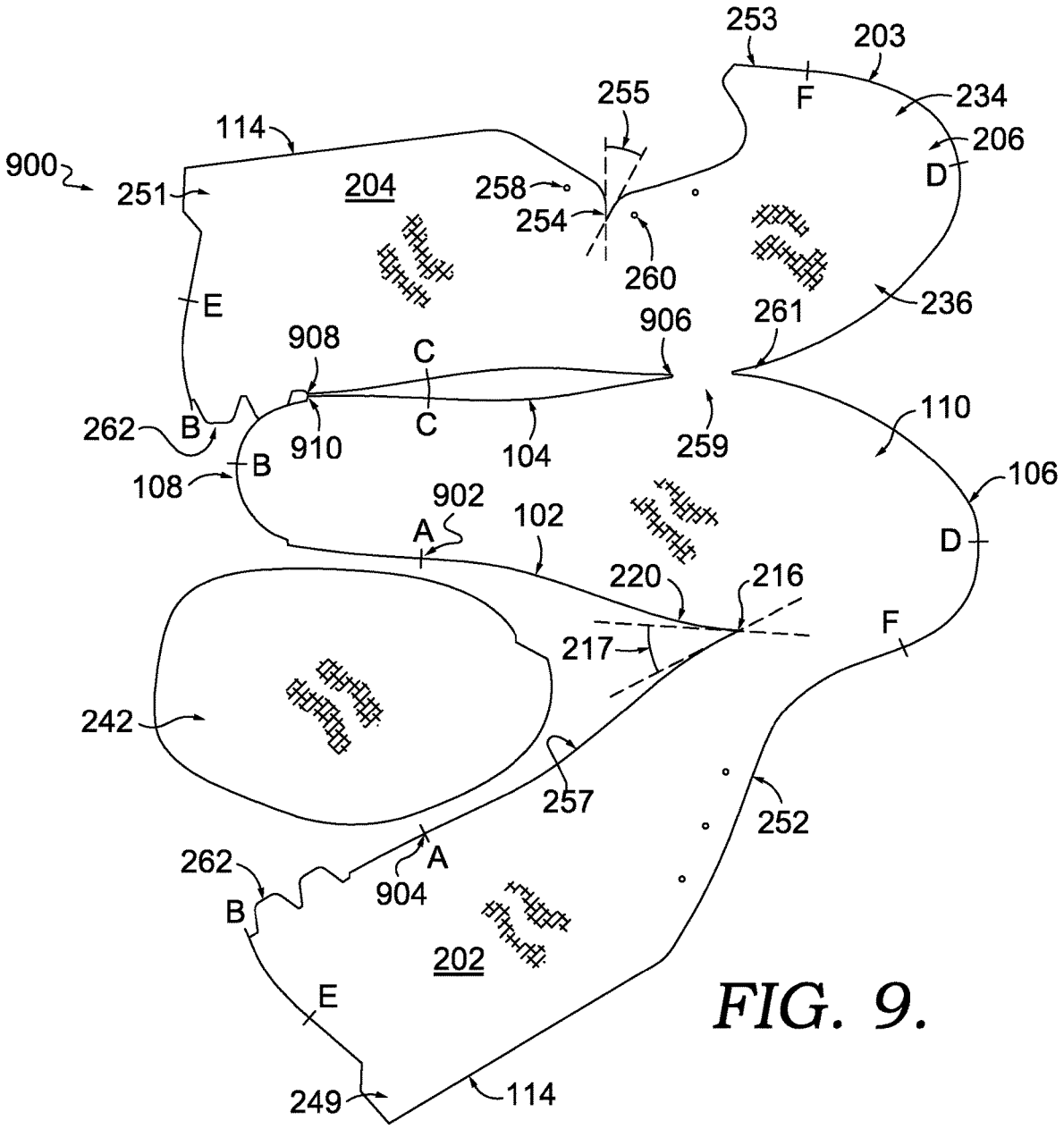
FIG. 9 depicts an alternative flat-pattern upper effective to form a dimensional article of footwear having similarities to the article of footwear depicted in FIGS. 1-6B.
Figure 10:
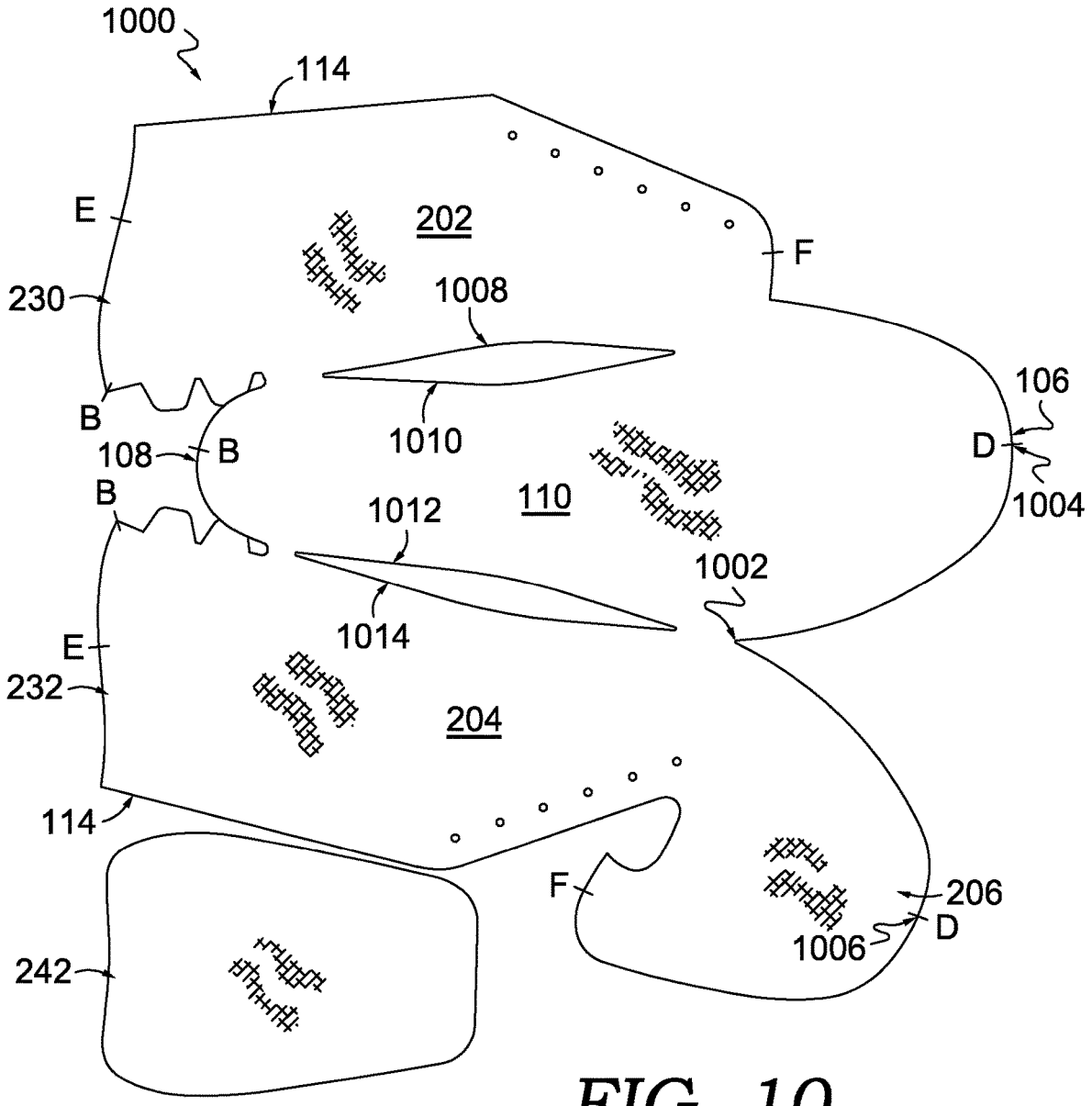
FIG. 10 depicts an alternative flat pattern upper having a non-integral tongue, in accordance with aspects hereof.

As used in this disclosure, "flat pattern" shall mean a substantially planar collection of materials, as generally depicted in FIGS. 8-10, that may be modified or shaped before being formed into a desired dimensional article of footwear (e.g., FIGS. 1-7), or portion thereof (e.g., an upper with a desired height, size, etc.). While different materials may be coupled to one another in a manner that forms textures, bumps, embossing, protrusions, and the like on the flat pattern, the collection of materials is still considered substantially planar, and therefore is considered "flat" even with such deviations in height and texture along the surface. The flat pattern, once formed about a cobbler's last (or other dimensional tooling) to create a receiving cavity in which a wearer's foot may be received, becomes a "dimensional article of footwear."

In exemplary aspects, a dimensional article of footwear is one that is formed so that it can be secured to and around a portion of a wearer (e.g., a wearer's foot). A "flat" pattern, in contrast to a "dimensional" article, is not formed to be received about a portion of a wearer (e.g., the wearer's foot). It should be noted that a "dimensional article of footwear" does not necessarily mean a fully formed article of footwear (e.g., a dimensional article of footwear may only be an upper without any one or combination of a sole, a sockliner, an underfoot portion, an interior liner, etc.). Further, relative terms, such as medial, lateral, toe-end, and heel end are used to describe relative portions of the article of footwear as a flat pattern upper and/or as dimensional footwear. These relative terms are representative of positions as commonly identified in a dimensional article of footwear. For example, a medial side of the article of footwear is more proximate a wearer's midline when in a traditional as-worn configuration and the lateral side of the article of footwear is more distal from the wearer's midline when in a traditional as-worn configuration.

The concept of a flat pattern is conducive to manufacturing, as many materials used to form a shoe upper are rolled or flat goods that are in a substantially planar (e.g., sheet-like) configuration in their raw state. Accordingly, construction of a shoe upper from a collection of flat components in an in-line manufacturing process may be advantageous from a material use, construction, and assembly efficiency standpoint. Furthermore, continuous in-line manufacturing allows for strategic implementation of engineered material properties, such as tensile strength, elongation characteristics, and moisture transportation, in an efficient manner on a flat pattern. The flat pattern concept may also provide greater consistency in manufacturing and greater ability to implement machines relative to a traditional dimensional upper manufacturing process. Additionally, variations in size, style, and/or materials used in shoe uppers are possible with an in-line manufacturing process, including within the same in-line manufacturing process.

Traditional construction of an article of footwear relies on numerous discrete portions that are attached (e.g., adhered, welded, stitched) together to form a dimensional article of footwear. The cutting, attaching, and forming of numerous discrete portions can increase material costs, increase production time, increase waste, and increase complexity of the resulting article of footwear. Therefore, as provided herein, an article of footwear formed with minimal discrete portions can decrease material costs (e.g., less waste), decrease production time (e.g., fewer attaching steps, fewer alignment steps), decrease waste, and/or decrease complexity of the resulting article of footwear. Aspects herein therefore contemplate an article of footwear having a flat pattern that results in a medial side seam extending from the throat to a toe end of the article of footwear to convert a flat pattern to a dimensional article of footwear. Additional aspects contemplate an article of footwear formed from a flat pattern upper that forms a heel-end seam extending from an ankle collar edge towards a biteline (e.g., region of intersection of a sole and the upper when formed as a dimensional article of footwear having a sole). This heel-end seam is formed with plain seam such that the inner face of a medial upper portion is adjacent to and facing an inner face of a lateral upper portion of the dimensional article of footwear. Yet another exemplary aspect contemplates an acute-angle indentation along a throat opening, such as the lateral edge of the throat opening. This acute-angle indentation allows an upper portion (e.g., a lateral upper portion) to transition as a single piece from a forefoot region containing the metatarsal and phalanx bones to the hind foot region containing the talus and calcaneus bones of a wearer when in a traditional as-worn configuration. The acute-angle indentation allows the throat opening to smoothly conform to the wearer's anatomy without puckering and wrinkling from a more vertical orientation in the hind foot region to a more horizontal orientation in the forefoot region. Any combination of aspects is contemplated as being implanted in exemplary article of footwear.

Figure 1:
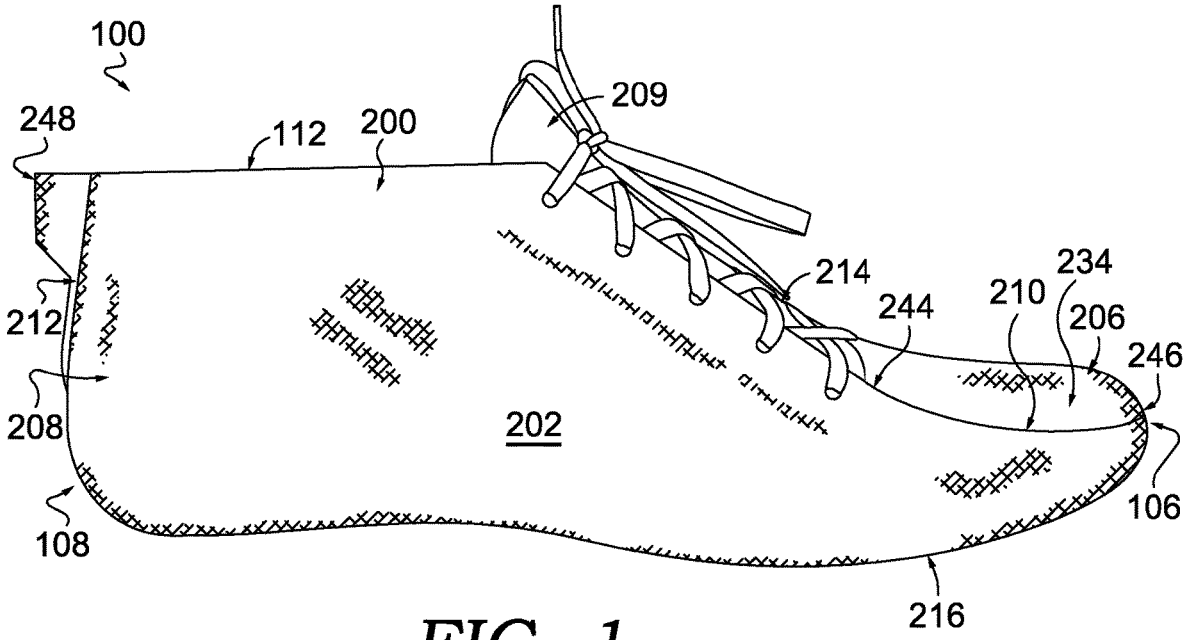
FIG. 1 depicts a medial side of an article of footwear, in accordance with an aspect hereof.
Figure 2:
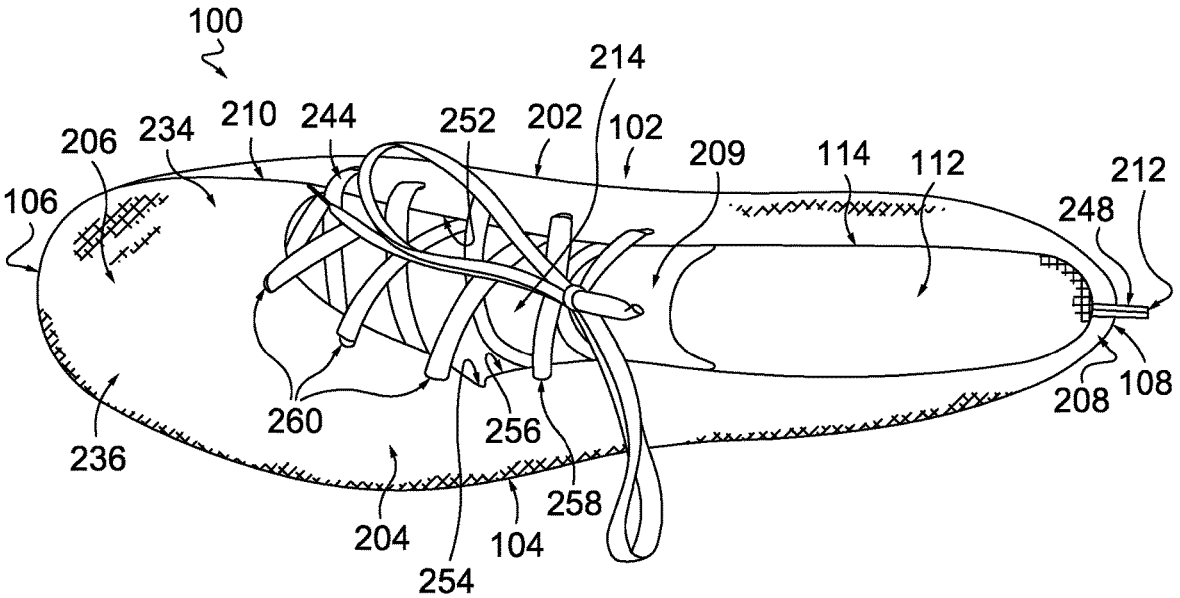
FIG. 2 depicts a plan view of the article of footwear from FIG. 1, in accordance with an aspect hereof.
Figure 3:
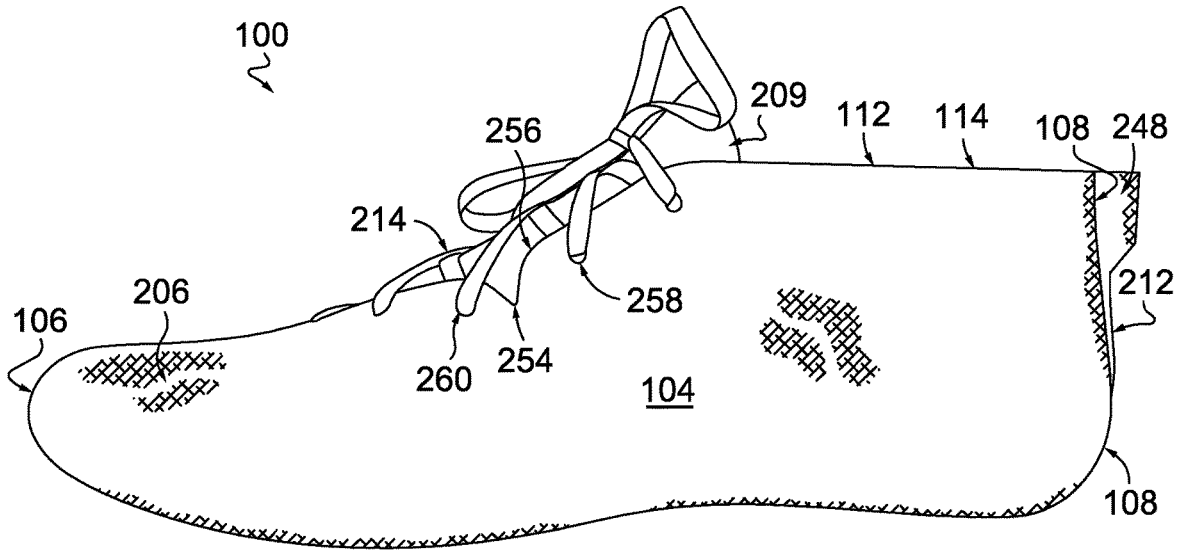
FIG. 3 depicts a lateral view of the article of footwear from FIG. 1, in accordance with an aspect hereof.
Figure 4:
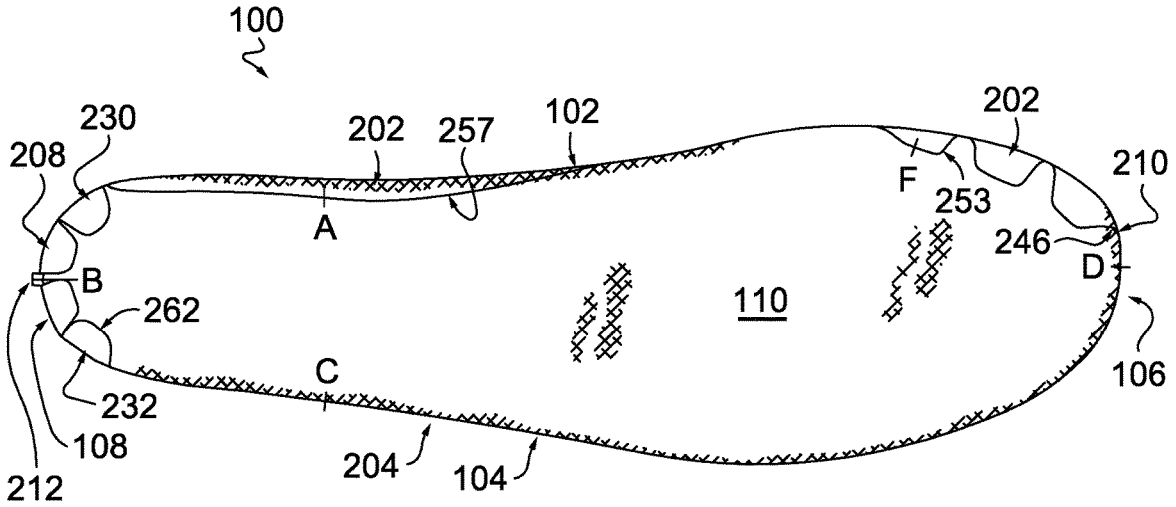
FIG. 4 depicts a bottom view of the article of footwear from FIG. 1, in accordance with an aspect hereof.
Figure 5:
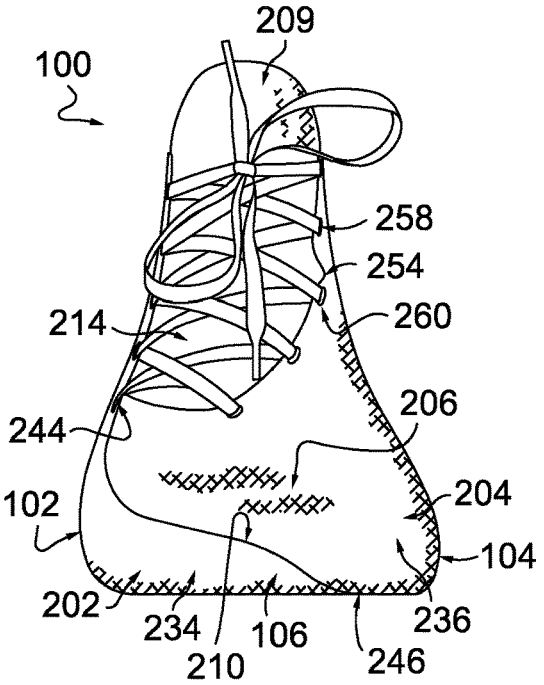
FIG. 5 depicts a toe-end view of the article of footwear from FIG. 1, in accordance with an aspect hereof.
Figure 6A:
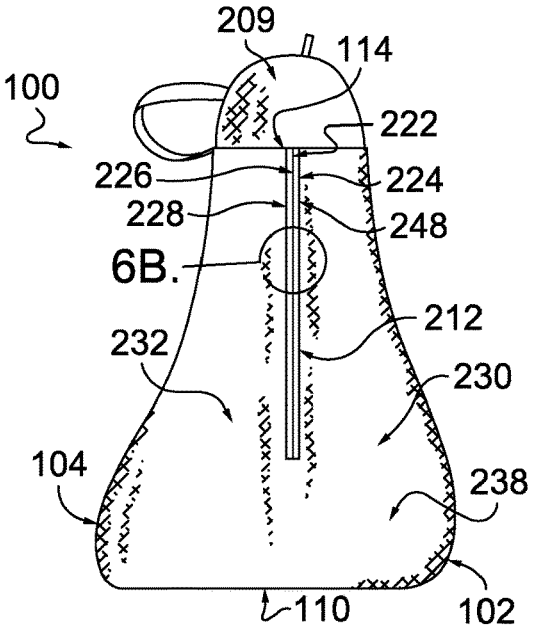
FIG. 6A depicts a heel-end view of the article of footwear from FIG. 1, in accordance with an aspect hereof.
Figure 6B:
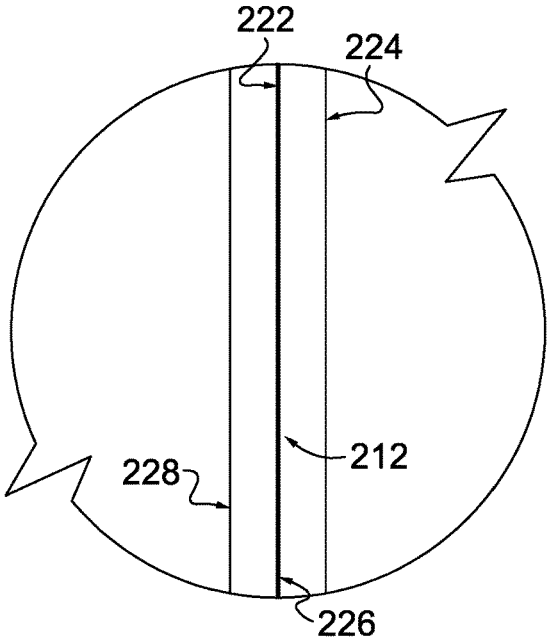
FIG. 6B depicts a magnified portion from FIG. 6A, in accordance with an aspect hereof.

FIGS. 1-6B depict an article of footwear 100, in accordance with aspects hereof. Specifically, FIG. 1 depicts a medial side 102, FIG. 2 depicts a top plan view, FIG. 3 depicts a lateral side 104, FIG. 4 depicts a bottom plan view, FIG. 5 depicts a toe end 106 view, FIG. 6A depicts a heel end 108 view, and FIG. 6B depicts a magnified view from FIG. 6A—all views of the article footwear 100, in accordance with aspects hereof.

Generally the article of footwear 100 is comprised of a toe end 106, a heel end 108, a medial side 102, and a lateral side 104. In an article of footwear, such as a shoe, an upper 200 is comprised of portions relating to the relative portions of the article of footwear. For example, the upper 200 is comprised of a medial portion 202 on the medial side 102, a lateral portion 204 on the lateral side 104, a heel portion 208 proximate the heel end 108, and a toebox portion 206 proximate the toe end 106. As can be appreciated, the medial portion 202 converts into the toebox portion 206, which converts into the lateral portion 204, which converts to the heel portion 208 as the upper 200 forms the article of footwear. However, as is generally appreciated, the toebox portion 206 extends between the medial portion 202 and the lateral portion 204 as best seen in FIG. 2. Similarly, the heel portion 208 extends between the medial portion 202 and the lateral portion 204 as best seen in FIG. 6A.

A brief discussion of a traditional wearer's foot provides insights into aspects provided herein. A traditional wearer's foot has a concave medial shape in the toe-to-heel direction in a midfoot region as the first metatarsal extends towards the medial cuneiform from the phalanges. It is this concave portion that is instrumental in placement of some features provided herein. For example, in an exemplary aspect, forming of a dimensional footwear from a flat pattern upper include a closure seam extending along a medial side of the article of footwear. In this example, the closure seam is positioned originating from a medial portion of a throat opening in part to conform to the concave portion of the wearer's foot without complex curves or seams being implemented. Additionally, the concave medial portion of a wearer's foot also, in an exemplary aspect, results in an acute-angle indentation on the opposite lateral side of a throat opening to compensate for the contouring of the article of footwear to coincide with the wearer's foot. Other features of a wearer's traditional foot also may support aspects provided herein.

The article of footwear 100 as depicted in FIG. 1 provides a view of the medial side, in accordance with aspects hereof. The upper 200 presents the medial portion 202 as well as a medial portion 230 of the heel portion 208 and a medial portion 234 of the toebox portion 206. At the heel end 108, a heel tab 248 is depicted. As will be discussed in greater detail in connection with FIG. 6A and FIG. 6B, the heel tab 248 is a tab extending heelwardly from a heel-end seam 212 that joins the medial portion 230 with a lateral portion 232 of the heel portion 208. The heel-end seam 212 is effective, in an exemplary aspect, to aid in converting a flat-pattern upper into a dimensional shoe. The heel tab 248 may provide additional securement of the upper 200 portions proximate the heel-end seam 212. For example, additional contacting surfaces of the upper 200 portions may provide a stronger joint, such as a plain seam joint, through an increased engagement surface area provided by the material forming the heel tab 248.

The article of footwear 100 is also comprised of an ankle opening 112. The ankle opening 112 allows for a wearer to don and doff the article of footwear 100, as is traditional. As best seen in FIG. 2, the ankle opening 112 may be defined by an ankle collar formed by the medial portion 202, the heel portion 208, and the lateral portion 204. In the example of the article of footwear 100, the heel-end seam 212 extends from the ankle collar 114 towards a biteline if not all of the way to a distal edge of the medial portion 202 and the lateral portion 204 in other examples. Further, it is contemplated that a heel-end seam may be omitted altogether in some aspects. Further, it is contemplated that the heel-end seam 212 may extend only partially toward the biteline from the ankle opening 112 as the seam forms a cupping element around a heel region of a wearer's traditional foot.

Returning to FIG. 1 and moving towards the toe end 106, a medial toe-end seam 210 is depicted. The medial toe-end seam 210 extends from a throat opening 214 towards the toe end 106. As best seen in FIGS. 4 and 5, the medial toe-end seam 210 may extend in a curvilinear manner across the toebox portion 206 from the medial portion 202 towards the lateral portion 204. For example, as seen in FIG. 5, the medial toe-end seam 210 may cross a medial portion 234 of the toebox portion 206 extending towards a lateral portion 236 of the toebox portion 206. The medial toe-end seam 210 may terminate underfoot as seen in FIG. 4.

The medial toe-end seam 210 on the article of footwear 100 joins two portions of the upper 200 allowing, at least in part, the upper 200 to form a dimensional article of footwear from a flat pattern. The medial toe-end seam 210 may be a welded, adhered, stitched, or otherwise joined junction between two otherwise separate portions of the upper 200. As will be discussed in greater detail hereinafter, the medial toe-end seam 210 may extend from a medial edge of the throat opening, such as at a throat end 244, as seen in FIG. 2, and extend to a toebox end 246, as seen in FIGS. 4 and 5. The throat end 244, in an example, may be a transition from a medial edge 252 of the throat opening 214, as depicted in FIG. 2. In this example, an edge of a flat pattern upper (e.g., see FIGS. 8 and 9 for examples) that forms the medial edge 252 also forms an edge captured in the medial toe-end seam 210.

While the medial toe-end seam 210 is depicted herein, it is contemplated that a similar joining seam may be implanted, in the alternative, on the lateral side in alternative exemplary aspects.

Moving to a lateral side of the article of footwear 100, an acute-angle indentation 254 is formed in a lateral edge 256 of the throat opening 214, as seen in FIG. 2. The acute-angle indentation 254 is an intentional deviation in the lateral edge 256 that allows the lateral portion 204 to conform to the contours of a wearer's traditional foot structure. As discussed previously, this conformance includes allowing the lateral portion 204 to transition from a more vertical orientation proximate the ankle opening 112 to a more horizontal orientation proximate the toebox portion 206 without causing a pinch point or other deformation that may reduce the fit of the article of footwear 100. As the lateral portion 204 and the toebox portion 206 are integral in the present example, the acute-angle indentation 254 allows those integral portions to conform with the wearer's traditional foot and to transition from the orientations of each of those respective integral portions.

As seen in FIG. 2, a first lace aperture 258 is positioned between the acute-angle indentation 254 and the ankle opening 112. It is contemplated that a plurality of lace apertures may be positioned in the region of the first lace aperture 258. A second lace aperture 260 is positioned between the acute-angle indentation 254 and the toebox portion 206. It is contemplated that a plurality of lace apertures may be included in the region of the second lace aperture 260. While the term "lace aperture" is used herein, it is contemplated that any fastening mechanism (e.g., grommets, hooks, slides, hook-n-loop, snaps, buttons) are included in the term lace aperture. As the acute-angle indentation 254 allows the upper 200 to conform to the structure of a wearer's traditional foot, the lacing (or other securing) mechanism connection in the region of the first lace aperture 258 and the lacing mechanism connection in the region of the second lace aperture 260 provides tension across the throat opening 214 that contours the upper 200 to the structure of the underlying traditional foot.

The acute-angle indentation 254 is acute, in an exemplary aspect, to allow conformance with the underlying structure without creating a significant break in the throat edge that could result from an obtuse angle. Similarly, a linear slit may not be implemented because the transition from a more vertical orientation to a more horizontal orientation at the intentional deformation (e.g., the acute-angle indentation 254) could result in overlap of material if a linear slit-like structure was used in place of an acute-angle indentation. The acute-angle indentation 254 may be any angle 255 between 1 and 89 degrees, in an exemplary aspect depicted in FIG. 8. Further the acute-angle indentation 254 may extend into the lateral portion 204 any distance, but a distance of 1 to 15 millimeters is contemplated.

As discussed, it is contemplated that the medial toe-end seam 210 originating from the medial edge 252 of the throat opening 214 in combination with an acute-angle indentation 254 positioned along the lateral edge 256 of the throat opening 214 provides, in a non-limiting example, an effective combination of structures that allow for conversion of a flat-pattern upper to a dimensional article of footwear with reduced operations from a traditional cut-and-sew technique of forming the article of footwear.

Further yet, as provided, the heel-end seam 212 may also be leveraged as extending from the ankle opening 112 downwardly towards (if not all of the way to) a lower edge in the heel portion 208. It is contemplated that a conversion from a flat pattern upper (e.g., FIGS. 8-10) to a dimensional article of footwear (e.g., FIGS. 1-7) may be accomplished with a limited number of joining operations, such the medial toe-end seam 210 and the heel-end seam 212.

FIG. 4 provides a foot-contacting surface view of the article of footwear 100, in accordance with aspects hereof. Specifically, FIG. 4 provides greater visibility to the joining of flat-pattern edges and surfaces to form a dimensional article of footwear. For example, the toebox end 246 of the medial toe-end seam 210 is shown at the toe end 106.

Further, a distal edge 253 (also shown in FIGS. 8 and 9) is depicted joining with a footbed portion 110 along a medial side of the toe end 106. Further, a medial portion edge 257 (also shown in FIGS. 8 and 9) is depicted as joining the medial portion 202 with the footbed portion 110. Further yet, a heel edge 262 (also shown in FIGS. 8 and 9) depicts the heel portion 208 coupling with the footbed portion 110 at the heel end 108. In aspects, edges to be joined with the footbed portion 110 have a common length and/or contour as the to-be-mated edges. For example, the medial edge portion 257 has a complimentary (e.g., mirror image) contour and a similar length to that of the edge of the footbed portion 110 to which it is to be joined, as will be discussed hereinafter.

Throughout the FIGS. 4, 8, 9, and 10, alignment markers are generally depicted to provide a visual indication as to where portions of a flat pattern upper may join to form a dimensional article of footwear. For example, an "A" identifier generally indicates where the medial portion 202 and the footbed portion 110 join along the medial portion edge 257. A "B" identifier generally indicates where the heel portion 208 and the footbed portion 110 join along the heel edge 262. A "C" identifier generally indicates where the lateral portion 204 and the footbed portion 110 join along a lateral side. A "D" identifier generally indicates where the toebox portion 206 and the footbed portion 110 join at the toe end 106. An "E" identifier generally indicates where the medial portion 230 and the lateral portion 232 of the heel portion 208 join at the heel-end seam 212. An "F" identifier generally indicates where the medial portion 202 and the toebox portion 206 join at the medial toe-end seam 210. These lettered indicators are to aid in the understanding of how various edges and surfaces of a flat pattern upper are manipulated and aligned in three-dimensional space to form a dimensional article of footwear. The lettered indicators do not represent exclusive points of joining, but instead represent general areas at which the edges/surfaces may join to convert from a flat pattern upper to a dimensional article of footwear. Additionally, the letter identifiers reinforce that to-be-joined edges are formed with a common length and/or contour to allow for a smooth joining that is absent of puckering (e.g., excess material on a first edge being joined with a second edge) and other deformations that could result from improper contouring and length combinations that are avoided in aspects hereof.

FIG. 6A provides a heel-end view of the article of footwear, in accordance with aspects hereof. Specifically, the heel-end seam 212 is depicted having the medial portion 230 and the lateral portion 232 of the heel portion 208 joining. The heel-end seam 212 extends from the ankle collar 114 downwardly towards the heel edge 262. However, as depicted in FIG. 6A and also depicted in the corresponding flat pattern of FIG. 8, the seam may only extend a portion of the way towards the heel edge 262 as the medial portion 230 and the lateral portion 232 may be integrally joined (e.g., not discrete portions proximate the heel end 108) at the heel edge 262. Therefore, the heel-end seam 212 may extend towards the biteline, but not all of the way to the biteline (nor all of the way to the heel edge 262), in some aspects.

In an exemplary aspect, the heel-end seam 212 is formed such that the lateral portion 232 has an inner surface 226 and an outer surface 228 and the medial portion 230 has an inner surface 222 and an outer surface 224. The inner surface 226 and the inner surface 222 are adjacent at the heel-end seam 212 to form a traditional "plain" seam. FIG. 6B depicts a magnified view from FIG. 6A to better illustrate the relationship of the portions and surfaces.

The term "adjacent" contemplates the described surfaces face each other, but it is contemplated that one or more additional materials (e.g., liner(s), adhesive layer(s), cushioning) may be positioned between the adjacent surfaces while still being considered "adjacent." In some aspects the inner surfaces are adjacent when they contact one another and in other aspects the inner surfaces are adjacent when they face one another with intervening materials disposed there between.

The formation of the heel-end seam 212 results, in the exemplary aspect of the article of footwear 100, in the heel tab 248. The heel tab 248 provides, in an exemplary aspect, reinforcement to the heel-end seam 212 at the ankle collar 114. The reinforcement results from an increased surface area of joined material caused by the heel tab 248. The heel tab 248 is also sized as extending downwardly 1 to 5 centimeters, in an exemplary aspect, from the ankle collar 114 to allow a wearer to grasp the heel tab 248 to aid in the donning and doffing of the article of footwear 100. Because of the limited seam constructions of the article of footwear 100, the heel tab 248 reinforcement and the ability of a wearer to grasp and compress (e.g., essential reinforcing the heel-end seam 212 during the manipulation of the heel tab 248) both the medial portion 230 and the lateral portion 232 at a common location of the heel tab 248 enhances the durability of the article of footwear 100, in exemplary aspects. Limiting the heelward extension of the heel tab 248 from 5 millimeters to 5 centimeters limits excess material while providing benefits provided above, in exemplary aspects.

Further, while a plain seam is described in connection with the heel-end seam 212, it is contemplated that any seam may be implemented in various aspects and the seam may be formed from any technique (e.g., stitch, weld, adhere).

FIG. 7 depicts the article of footwear 100 having a sole 300, in accordance with aspects hereof. The sole 300 is non-limiting in nature as it is contemplated that any sole structure may be implements in various aspects. FIG. 7 does provide an illustration of a biteline 238. The biteline 238 is the line formed from the junction of the sole 300 and the upper 200. Soles may have different constructions and therefore may have different biteline resulting in connection with the article of footwear. However, a biteline represent a transition from the sole structure to the upper. Because a biteline is a transition between the sole and the upper, it is typical (but not necessary) for aspects of the article of footwear to be locked down through mechanical engagement below the biteline. For example, a sole may be adhered (e.g., glued) or otherwise joined (e.g., over molded, stitched) to the upper. This connection between the upper and the sole further reinforces or aids in joining materials of the upper included in the joining of the upper and the sole. For example, portions of the medial toe-end seam 210 at the toe end 106 may be joined with the sole 300. The inclusion of a portion of a seam or material from the upper 200 with the connection of the sole 300 may reinforce the seam/material and it may limit flexibility and movement of the seam/material. As a result, the upper 200 may respond (e.g., strength, toughness, flexibility, stretch) differently below the biteline 238 (e.g., more proximate a ground contacting surface) than above the biteline 238, in exemplary aspects.

FIG. 8 depicts a flat-pattern upper 800, in accordance with aspects hereof. The flat pattern upper 800 converts into a dimensional article of footwear as represented by the article of footwear 100 of FIGS. 1-6A. Surfaces, portions, edges, and other elements described in connection with FIGS. 1-6A are depicted on the flat pattern upper 800 of FIG. 8.

The flat patter upper 800 is comprised of an integral tongue 240 that is integral with the medial portion 202. The medial portion 202 is integral with the lateral portion 204 across a continuous region 250 that extends between the medial portion 230 and the lateral portion 232 of the heel portion 208. The lateral portion 204 extends integrally to the toebox portion 206 by way of the lateral portion 236 of the toebox portion 206. The lateral portion 204 also includes the acute-angle indentation 254 having the angle 255 along the lateral edge 256 that will define the throat opening 214 when formed in the dimensional shoe represented in FIGS. 1-6A.

As depicted in FIG. 8, an acute angle 217 is formed at a medial toe-end edge 220 of the footbed portion 110 intersecting with the medial portion edge 257. This acute angle 217 is positioned at medial apex 216 of the footbed portion. The medial apex 216 is associated with a "ball" region of a wearer's traditional foot. The ball region represents a region of greatest width in the medial to lateral direction of the footwear. Positioning the junction of the medial portion 202 and the footbed portion 110 at the medial apex 216 aids in forming a dimensional shoe having a medial toe-end seam. For example, a junction formed between the medial portion edge 257 and the footbed portion 110 (e.g., letter indication "A" generally defines the relationship of this junction) terminates in the toe-end direction proximate a location at the start of the medial toe-end seam 210. Stated differently, aspects contemplate limiting overlap of multiple junctions/seams along a common side of the article of footwear in the longitudinal direction (i.e., longitudinal in a toe-to-heel direction). This limitation of overlap in seams and junctions in the longitudinal direction can aid in manufacturing (e.g., ease alignment) and provide a more durable construction. As such, by having the toe-end seam 210 terminate in a longitudinal direction at an approximate location of the medial apex 216, the junction formed between the medial portion edge 257 and the footbed portion 110 may minimally overlap with the toe-end seam 210.

The integral tongue 240 provides a reduction in manufacturing processes as the integral nature of the integral tongue 240 with the medial portion 202 limits later alignment steps to join a tongue with the article of footwear. Further, as depicted in FIG. 8, an overlapped layer is formed when the integral tongue 240 and the medial portion 202 are folded to form the medial edge 252 of the throat opening 214. This overlapped material reinforces the medial edge 252. The overlapped material along the medial edge 252 when formed as a dimensional shoe also provide a visual continuity from the medial toe-end seam 210 that extends from the toe-end portion of the medial edge 252.

FIG. 8 depicts an exemplary pattern engineered as useable to form an article of footwear efficiently and attractively, in an exemplary aspect. For example, a contour matching and length matching between to-be-joined edges is utilized in the pattern to limit puckering and gathering of material as the edges are joined. For example, specific points, 802, 804, 806, 808, 810, 812, 814, 816, 818, and 820 are depicted corresponding to the positioning of the letter identifiers previously discussed (i.e., "A," "B," "C," "D," and "F"). A segment of an edge extending from medial apex 216 to point 802 has a similar length to an edge segment extending from medial apex 216 to point 804. Similarly, a contour (e.g., shaping of the edge and curvature of the edge in the plane of the flat pattern) of the segment of the edge segment extending from medial apex 216 to point 802 has a similar, but a mirror image, contour of the edge segment extending from medial apex 216 to point 804. An edge segment length from point 810 to point 814 is similar (e.g., equal) to an edge segment length from point 812 to point 816. A similar, but mirrored, contour for the edge segment from point 810 to point 814 is comparable to the contour of the edge segment from point 812 to point 816. This relationship between length and/or related contouring allows for efficient construction of an article when joined by limiting edge manipulation and alignment during the joining processes.

FIG. 9 depicts a flat-pattern upper 900, in accordance with aspects hereof. Specifically, when formed into a dimensional article of footwear, the flat-pattern upper 900 forms a dimensional article of footwear similar in constructions to the flat-pattern upper 800 of FIG. 8. However, the flat-pattern upper 900 lacks the continuous region 250 of FIG. 8 in the heel portion 208. As a result, the heel-end seam extends from the ankle collar 114 to the heel edge 262. In this example, both the flat-pattern uppers of FIGS. 8 and 9 provide a heel seam that extends from the ankle opening towards the biteline, but the heel seam resulting from the flat pattern upper 900 extends past the biteline, in an exemplary aspect.

Additionally, the flat-pattern upper 900 has a non-integral tongue 242 unlike the integral tongue 240 of FIG. 8. The non-integral tongue 242 may provide a different material usage than an integral tongue. This is, in part, because a non-integral tongue may be positioned and oriented within a region of material to increase efficient use of the material rather than to maintain an integral nature. The non-integral tongue 242 may be joined with the upper during a manufacturing stage of forming a resulting article of footwear.

The flat-pattern upper 900 is structured with the lateral portion 204 integral with the footbed portion 110 along a lateral edge 261 proximate a lateral apex 259 of the footbed portion 110. As with the medial apex 216 described in connection with FIG. 8, the lateral apex 259 is in a ball portion of the footbed near a ball width in the medial-to-lateral direction. The position of integral connection between the lateral portion 204 and the footbed portion 110 at the lateral apex 259 can aid in the manufacturing and eventual fit of the upper to a wearer's traditional foot.

The footbed portion 110 is integral with the medial portion 202 starting at the medial apex 216 for reasons similar to those discussed in connection with FIG. 8, for example. The similarly numbered surfaces, edges, portions, and elements of FIG. 9 to FIGS. 1-8 represent similar elements. FIGS. 8 and 9 provide an example of different flat pattern upper configurations that can be formed into similar dimensional articles (e.g., similar to the article of footwear 100 of FIGS. 1-6B).

FIG. 9, like FIG. 8, provides a number of points along the pattern edge. Points 902, 904, 906, 908, and 910 are exemplary in nature, but provide support for a discussion on pattern engineering where the flat pattern is formed with similar edge segment lengths and/or contours for two or more to-be-joined edges, in accordance with aspects hereof. For example, an edge segment extending between point 906 and 908 has a similar length and mirrored contour to an edge segment extending between points 906 and 910. These edge segments form a concave portion of the to-be-formed dimensional article around a lateral instep region of a wearer's foot without introducing puckering or other gathered material during the edge joining. This pattern engineering results in a fit and aesthetic that may not be accomplished with disparate lengths and/or contours. An edge segment extending from medial apex 216 to point 902 has a similar length and mirrored contour to an edge segment extending between the medial apex 216 and point 904. It is understood that variations to length and/or contouring may be introduced for one or more of these edge segments to insert an intentional gathering or puckering of material in some aspects.

FIG. 10 provides an alternative flat pattern upper 1000, in accordance with aspects hereof. The flat pattern upper 1000 provides features similar to those discussed with respect to FIG. 9; however, the non-integral tongue 242 is positioned at an alternative location. As such, it is understood that variations of position, orientation, and size of elements discussed herein may be provided while still resulting in an article of footwear having a reduced seam construction providing for efficient manufacturing of a resulting dimensional article of footwear.

In the examples of FIG. 10, the medial portion 202 may be integral with the footbed portion 110 at both the ball region and at the heel region. Similarly, the lateral portion 204 may be integral with the footbed portion 110 at both the ball region and the heel region. While the integral nature may be changed in various aspects of the depicted flat pattern, an increased number of integral connections between the medial portion 202, the lateral portion 204, and the footbed portion 110 may be effective to increase manufacturing operations as a reduction in alignment steps for joining the portions as a dimensional article of footwear. As previously discussed, a relationship between edge segment length and/or contouring of to-be-joined edges may be engineered into patterns for forming a dimensional article of footwear from a flat pattern. For example, FIG. 10 provides points 1002, 1004, and 1006. An edge segment extending between points 1002 and 1004 may have a similar length and/or mirrored contour as an edge segment extending between point 1002 and point 1006. Additional edge segments 1008, 1010, 1012, and 1014 are identified for illustration purposes. For example, edge segment 1008 has a similar length and/or contour to edge segment 1010. Edge segment 1012 and edge segment 1014 have a similar length and/or contour. As such, in exemplary aspects, the respective edge segments may be joined with limited material gather that reduces manufacturing time and costs.

The term "integral" as used herein refers to a continuation between two elements that is not generated in a post-processes step. For example, a material may be knit, woven, braided, or otherwise formed as a base material that is then formed into a flat-pattern upper (e.g., formed through a cutting operation). Subsequent to being formed into a flat pattern upper, two portions are integral if they remain physically joined without subsequent joining operations (e.g., welding, adhering, and stitching).

The materials contemplated for forming aspects provided herein include, but are not limited to, woven, knit, braided, embroidered, cast, extruded, non-woven, pressed, and the like. The materials include polymer-based material (e.g., nylon, polyester, aramids), peptides (e.g., cotton, hide, wool, cellulose fiber), and combinations of the same. For example, a flat pattern upper may be formed from a combination of a non-woven polymer-based material having one or more peptide-based materials joined (e.g., laminated, adhered, welded, stitched, and entangled). Any combination of material and material formation technique is contemplated.

For clarity, an article of footwear (e.g., article of footwear 100 of FIGS. 1-6B) having a medial side 102, a lateral side 104, a toe end 106, a heel end 108, and a medial toebox seam (e.g., medial toe-end seam 210 of FIGS. 1-6A) may comprise a footbed portion 110; a medial upper portion (e.g., medial portion 202); and a lateral upper portion (e.g., lateral portion 204). The medial upper portion and the lateral upper portion form a seam (e.g., the medial toe-end seam 210) extending from the footbed portion to a throat opening 214 along a medial portion 234 of a toebox portion 206.

From the foregoing, it will be seen that the invention is one that is well adapted to attain all the ends and objects hereinabove set forth together with other advantages, which are obvious and which are inherent to the structure. It will be understood that certain features and sub-combinations are of utility and may be employed without reference to other features and sub-combinations. This is contemplated by and is within the scope of the claims. While the subject matter of this disclosure is illustrated herein with specific examples, variations within the scope of the claims are possible and contemplated.

What is claimed is:

1. An article of footwear having a medial side, a lateral side, a toe end, a heel end, and a heel seam, the article of footwear comprising:

a foot bed portion;

a medial upper portion having a first inner surface and an opposite first outer surface;

a heel tab; and a lateral upper portion having a second inner surface and an opposite second outer surface, wherein the medial upper portion and the lateral upper portion are secured to each other at a curvilinear seam extending from the foot bed portion on the lateral side across a toe box portion of the article of footwear to a throat opening on the medial side, wherein the medial upper portion and the lateral upper portion are discontinuous at the heel end lacking a continuous region and join at the heel seam extending from an ankle collar towards a bite line with the first inner surface of the medial upper portion and the second inner surface of the lateral upper portion adjacent at the heel seam, wherein the heel tab extends heelwardly.

2. The article of footwear of claim 1, wherein the medial upper portion is integral with the foot bed portion at a medial toe-end apex region.

3. The article of footwear of claim 1, wherein the medial upper portion is continuous with the foot bed portion.

4. The article of footwear of claim 1, wherein a medial toe-end edge of the foot bed portion seamlessly transitions to a medial edge of the throat opening of the medial upper portion.

5. The article of footwear of claim 1, wherein the lateral upper portion is continuous with a lateral portion of the toe box portion.

6. The article of footwear of claim 1, wherein the lateral upper portion is continuous with a lateral portion of the toe box portion across to the curvilinear seam of the medial upper portion of the toe box portion.

7. The article of footwear of claim 1, wherein the heel seam bisects the heel end.

8. The article of footwear of claim 1, wherein the heel seam extends from the ankle collar to the bite line.

9. The article of footwear of claim 1, wherein the medial upper portion and the lateral upper portion extend heelwardly from the heel seam a greater amount at the ankle collar than at the bite line.

10. The article of footwear, according to claim 1, wherein the heel tab extends heelwardly between five millimeters and five centimeters, and downwardly between one centimeter to five centimeters from the ankle collar.

11. An article of footwear having a medial side, a lateral side, a toe end, a heel end, and a heel seam, the article of footwear comprising:

a foot bed portion;

a medial upper portion; and a lateral upper portion comprising a throat-opening edge that extends from an ankle collar to a toe box portion, wherein the throat-opening edge comprises an acute angle indentation between an ankle opening and the toe box portion on the lateral side; and wherein an upper of the article of footwear includes an expanse extending continuously and seamlessly through the foot bed portion, the medial upper portion, and the lateral upper portion, wherein the medial upper portion and the lateral upper portion are secured to each other at a curvilinear seam extending from the foot bed portion on the lateral side across the lateral upper portion along the medial upper portion to a throat opening on the medial side.

12. The article of footwear of claim 11, wherein the lateral upper portion further comprises a first pair of lace apertures between the ankle collar and the acute angle indentation.

13. The article of footwear of claim 12, wherein the lateral upper portion further comprises of a second pair of lace apertures between the acute angle indentation and the toe box portion.

14. The article of footwear of claim 11, wherein the medial upper portion is integral with the foot bed portion at a medial toe-end apex region.

15. The article of footwear of claim 11, wherein the lateral upper portion is continuous with a lateral portion of the toe box portion across to the curvilinear seam of the medial upper portion of the toe box portion.

16. The article of footwear of claim 11, wherein the lateral upper portion is continuous with a lateral portion of the toe box portion.

17. The article of footwear of claim 11, wherein the heel seam extends from the ankle collar to a bite line.

18. The article of footwear of claim 11, wherein a medial toe-end edge of the foot bed portion seamlessly transitions to a medial edge of the throat opening on the medial side.

19. The article of footwear, according to claim 11, further comprising a heel tab, wherein the heel tab extends heelwardly between five millimeters and five centimeters, and downwardly between one centimeter to five centimeters from the ankle collar.

* * * * *